US012234082B2

(12) United States Patent
Perlman

(10) Patent No.: US 12,234,082 B2
(45) Date of Patent: Feb. 25, 2025

(54) ROTATIONALLY STABILIZED WINE BOTTLE WITH ROTATIONALLY CONTROLLING BUMPERS

(71) Applicant: Brandeis University, Waltham, MA (US)

(72) Inventor: Daniel Perlman, Arlington, MA (US)

(73) Assignee: Brandeis University, Waltham, MA (US)

( * ) Notice: Subject to any disclaimer, the term of this patent is extended or adjusted under 35 U.S.C. 154(b) by 0 days.

(21) Appl. No.: 18/224,858

(22) Filed: Jul. 21, 2023

(65) Prior Publication Data

US 2024/0034544 A1 Feb. 1, 2024

Related U.S. Application Data

(60) Provisional application No. 63/393,364, filed on Jul. 29, 2022.

(51) Int. Cl.
*B65D 85/30* (2006.01)

(52) U.S. Cl.
CPC ..... *B65D 85/307* (2013.01)

(58) Field of Classification Search
CPC ..... B65D 85/307; B65D 2501/0018; B65D 2501/0045; B65D 2501/0081
USPC ..... 206/521; 215/382; 248/688, 345.1
See application file for complete search history.

(56) References Cited

U.S. PATENT DOCUMENTS

D149,394 S * 4/1948 Allen ..... D9/551
6,112,925 A * 9/2000 Nahill ..... B65D 1/0215 215/381
D539,660 S * 4/2007 Bunch ..... D9/557
D607,740 S * 1/2010 Eisen ..... D9/551
8,939,316 B2 * 1/2015 Pasutanon ..... B29D 22/003 220/675
9,861,551 B2 * 1/2018 Taylor ..... A61H 15/0092
10,894,625 B1 * 1/2021 Wilson ..... C08J 7/06
11,628,973 B2 * 4/2023 Robin ..... B65D 81/022 206/521
11,718,440 B2 * 8/2023 Fournier ..... B65D 23/12 206/521
2003/0010744 A1 * 1/2003 Ma ..... B65D 1/0223 215/382
2010/0102023 A1 * 4/2010 Yarro ..... B65D 81/365 215/382

FOREIGN PATENT DOCUMENTS

CN 114144360 * 3/2022
GB 2209511 * 5/1989

* cited by examiner

*Primary Examiner* — Rafael A Ortiz

(74) *Attorney, Agent, or Firm* — Troutman Pepper Locke LLP

(57) ABSTRACT

A substantially cylindrical glass bottle that is susceptible to accidental rolling and breakage when stored on its side has been structurally modified by forming a series of between approximately 8 and 24 small protrusions or bumpers spaced apart at regular intervals along either one path or two separated paths around the bottle's circumference at certain distances from the shoulder and base of the bottle. The bumpers project outward between approximately 2 mm to 6 mm from the bottle's outer sidewall surface, and pairs of these bumpers stably support the bottle stored on its side without the bottle rocking or rolling.

19 Claims, 7 Drawing Sheets

ROTATIONALLY STABILIZED WINE BOTTLE WITH ROTATIONALLY CONTROLLING BUMPERS

CROSS-REFERENCE TO RELATED APPLICATION

This application claims priority to, and the benefit of, U.S. Provisional Application No. 63/393,364, filed on Jul. 29, 2022. The contents of this application are incorporated herein in their entirety.

FIELD OF THE INVENTION

This technology generally relates to glass bottles and, more particularly, to glass bottles (e.g., wine bottles) having a body portion that is essentially cylindrical in shape, and to methods of making and modifying the architecture of such bottles to produce a rotationally stabilized bottle that resists accidental rolling and resulting breakage, in which rotational set points control bottle rotation, aid in the stacking of bottles, removal of lees and sediment from bottles, and also aid in keeping identifying labels visible on the upper surface of horizontally displayed bottles.

BACKGROUND

Conventional glass wine bottles used for packaging and selling wines include but are not limited to Bordeaux and Burgundy style bottles having body portions that are essentially cylindrical (e.g., round) in cross-section. For various reasons including maintaining desirable moisture levels in cork wine bottle closures as well as allowing space-efficient storage of wine bottles, such bottles are often stored on their sides. Unfortunately, unless confined by physical barriers, horizontally stored bottles are susceptible to accidentally rolling from a shelf and shattering on a hard floor. Additionally, the ease with which horizontal wine bottles can roll makes it challenging to store multiple layers of stacked bottles unless the stacks are placed in a walled or otherwise confined space. Furthermore, when a bottle is stored on its side at home or on a store shelf, the easy rotation of such bottles makes it difficult to keep a wine-identifying label facing upward and visible. Additionally, certain varieties of wines such as Champagnes require riddling or "remuage" (French), i.e., the removal of lees or sediment after bottling. The process involves turning a tilted bottle in which the bottle's body is rotated in small increments (e.g., ¼ to ⅛ of a turn every day or two) allowing gravity to draw sediment into the neck of the bottle for removal (disgorgement). Tracking these incremental rotations can be challenging.

Exemplary devices are found in the prior art that prevent a round bottle from rolling. These include a variety of bottle accessories that physically secure round bottles such as bottle-holding bags and frictionally mounted square-shaped sleeves that prevent bottle rotation. Additionally, the shapes of some bottles have been altered to include essentially polygon-shaped cross-sections, e.g., rectangular, square, or hexagonal bottle cross-sections, providing a flat and stable resting surface that prevents bottle rolling. While bottle storage accessories and bottle modifications may be implemented, adding devices to bottles may be inconvenient and cumbersome when storing many bottles of wine. The more radical strategy of altering a wine bottle's essential geometry, i.e., from the cylindrical cross-section to a square or polygon cross-section, may introduce unanticipated problems and costs. These include but are not limited to the large cost of molding and handling newly shaped glass bottles while increasing the amount of glass required for molding bottles that have a strength and impact resistance comparable to a cylindrical-shaped bottle that holds the same volume of liquid. In recent years there have been a few examples of wines being packaged and sold in bottles with square cross-sections. The French wine producer Château de Berne has been packaging wine in square bottles for over a decade. Matuba Vineyards in South Africa and Truett Hurst Vineyards in California have likewise offered wines in square bottles. It is claimed that these bottles take up less space than round bottles in shipping and storing, and because the bottles do not roll away, they can be more easily stored on their sides. However, the square wine bottle has, to the present time, remained more of a curiosity than a commercial success.

SUMMARY

The present invention features a molded glass bottle (e.g., a glass wine bottle) with a generally cylindrical cross-section (e.g., a round shape), size, and interior that appear remarkably similar to a conventional glass bottle. Like conventionally manufactured glass bottles, the present bottles have a neck portion, shoulder portion, substantially cylindrical body portion, heel or base portion and, optionally, a recessed punt portion forming the bottom of the bottle (see FIGS. 1A and 1B). The shoulder portion is located immediately above the substantially cylindrical body portion, and the heel or base portion is located immediately below the substantially cylindrical body portion. Notably however, the exterior surface of the essentially cylindrically-shaped body portion of the present bottle can include a series of regularly spaced protrusions (also referred to herein as "bumpers") around the bottle's circumference on an otherwise smooth wall surface. The bumpers can be positioned on the body of the bottle at the same distance (e.g., approximately 1 inch to 2 inches) from the base of the glass bottle and/or from the shoulder of the glass bottle (i.e., a circumferential path of bumpers near the base of the glass bottle and/or a circumferential path of bumpers near the shoulder of the glass bottle). The circumferential paths can be separated by about 3-7 inches, preferably about 4-6 inches, measured along the central axis of the 750 ml bottle or the 1.5 L bottle.

The bumpers can vary in their extent of protrusion (also referred to herein as projection) as measured outward from the outer wall surface of the bottle and/or can vary in their overall size and shape. For example, rounded-top or beveled-top bumpers can project outward about 2 mm-5 mm from the outer sidewall surface of a 750 ml bottle (FIG. 2) or 3 mm-6 mm from the outer sidewall surface of a 1.5 L bottle (FIG. 5). The bumpers can be of any geometrical size and shape, e.g., small and round (0.5 to 1 cm diameter), or oval or even square, or the bumpers may be narrow and elongated as protruding strips extending for either a part, or for the entire length, of the body portion of the bottle. The bumpers can also be beveled. The bumpers can be positioned, sized, and shaped to prevent the glass bottle, resting on its side, from undesirable free rotation and rolling on a smooth flat surface (see FIGS. 3 and 4). Sequential pairs of the bumpers can also provide set rotational positions, i.e., "rotational set points" for the bottle, allowing intermittent and/or regular set rotation of the bottle around its central axis as employed during removal of sediment or lees. The bumpers can be formed on a bottle together with the rest of the bottle when the bottle is formed by molding, e.g., formed from molten glass or from a thermoplastic resin material such as PET. Because the presently modified glass bottles can be manufactured from a thermoplastic resin, the term "glass" as used herein to describe wine bottles also includes thermoplastic resins. Such thermoplastic resins include but are not limited to PET (polyethylene terephthalate), polyethylene, polypropylene and the biopolymer, PLA (polylactide).

The overall shape of the interior and exterior of the bottle's body portion remain essentially cylindrical. However, while the interior surface of the body portion remains round and smooth without any surface discontinuities (e.g., essentially identical to a conventional Bordeaux or Burgundy style glass wine bottle), the exterior surface of the bottle's body portion has been altered. More specifically, the exterior surface can be disrupted by a series of regularly spaced surface discontinuities that are integrally molded in the form of multiple low-profile glass protrusions or bumpers on the outer wall surface of the bottle. For example, the molded protrusions may be, for example, between 8 and 20 low profile bumpers, preferably 8 or 9 low profile bumpers that are regularly spaced around one circumferential path around the body portion of the bottle, or alternatively between 16 and 18 low profile bumpers regularly spaced around two parallel circumferences or circumferential paths around the body portion of the bottle. The bumpers are provided in the form of a geometric shape such as round buttons or alternatively, narrow strips of various lengths essentially parallel to the central axis of the bottle. Each protrusion (termed "bumper" herein, regardless of the shape or dimension) projects outward from the outer sidewall surface of the bottle between approximately 2 mm to 6 mm, e.g., between approximately 2 mm and 4 mm (preferably about 2.5 mm to about 3 mm) for a 750 ml bottle and about 3 mm to about 6 mm for a 1.5 L bottle (preferably between about 4 and about 5 mm) and between approximately 2 and 10 mm wide. For example, when the body portion of a 750-1000 ml capacity wine bottle having a diameter of between approximately 3 and 3.5 inches is viewed in cross-section and the bumpers are viewed in pairs around the circumference of the bottle, the bumpers are of sufficient height so that a tangent line drawn between the highest or tallest points on neighboring bumpers does not intersect the surface of the bottle between neighboring bumpers (see black protrusions in FIG. 4). That is, the tangent line (T) should preferably lie slightly outside the surface of the 750 ml bottle between neighboring bumpers. Thus, when a bottle is placed on its side on a flat shelf surface, a pair of bumpers can support the bottle without the convex sidewall surface of the bottle's body contacting the shelf surface to cause rocking and instability of the bottle. Similarly, the tangent line T should preferably lie slightly outside the surface of a 1.5 L bottle with an approximately 4.1-4.2 inch diameter.

As described above, the bumpers can be formed in many different geometric shapes, e.g., as small round button-shaped bumpers or even narrow strips (continuous or interrupted strips) oriented parallel to the central axis of the bottle. The bumpers can be generally formed during bottle molding from either a molten glass or from a thermoplastic resin at the same time as the entirety of the bottle is molded. In a preferred embodiment, the bumpers comprise glass or a thermoplastic resin. The bumpers can be positioned on the outer sidewall surface of the bottle's substantially cylindrical body portion. The bumpers can be positioned and spaced apart at regular intervals, e.g., at approximately 0.9-1.5 inch intervals around a 750-1000 ml wine bottle's circumference, preferably spaced at between 1.0 and/or 1.3 inch intervals (center to center distance between bumpers). The circumference of a 750 ml capacity glass wine bottle measures approximately 9.0-9.5 inches. The bumpers can be positioned and spaced apart at regular intervals, e.g., at approximately 1.2-1.8 inch intervals around a 1.5 L wine bottle's circumference, preferably spaced at between 1.3 to 1.6 inch intervals (center to center distance between bumpers). The circumference of a 1.5 L capacity glass wine bottle measures approximately 13.0 inches, with a typical diameter of approximately 4.1-4.2 inches. As described above, the bumpers or protrusions may be formed as short or long strips (e.g., between 1 cm and 15 cm in length) or alternatively formed as round button-shaped elements, all of which have adequate height to stabilize a wine bottle against rocking and/or rolling. These bumpers generally project from the outer sidewall surface of the bottle between 2 mm and 6 mm (preferably between about 2 mm to about 4 mm and more preferably between about 2.5 mm to about 3 mm for a 750 ml bottle, and preferably between about 3 mm to about 6 mm and more preferably between about 4 mm and about 5 mm for a 1.5 L bottle) and generally are between 2 mm and 10 mm wide and are spaced apart at similar intervals, depending on the size of the bottle, around the circumference of the bottle's body portion. The spacing and height of each successive pair of these protrusions around the circumference can allow a conventional 750 ml glass wine bottle (having an outer diameter of approximately 3 inches) or a 1.5 L bottle (having an outer diameter of approximately 4.1-4.2 inches) to be rested and stored on its side, e.g., on a shelf, where the bottle is stabilized against rolling as it stably rests on pairs of the bumpers. By comparison, when a bottle with a cylindrical body portion is stored on its outer sidewall surface, the bottle is often susceptible to rolling and accidental breakage. The presence of the above-described oriented protrusions that serve as stabilizing feet on a bottle's body sidewall can also facilitate bottle stacking by limiting bottle rotation around the central axis of a bottle. By limiting such rotation, the protrusions can also aid in maintaining bottle orientation required for desirable upward display of a wine bottle's label when a bottle is displayed horizontally. Furthermore, the ability to control rotation of a wine bottle between successive pairs of protrusions supporting a wine bottle on its side facilitates manual riddling and removal of the lees or sediment in a wine such as a champagne. More specifically, with the protruding bumpers being spaced apart in discrete intervals around the circumference of the bottle, a controlled step-wise rotation of the bottle in discrete angular increments can be facilitated, e.g., in steps of 30 to 60 degrees, and preferably 40-45 degrees, for a 750-1000 ml bottle or a 1.5 L bottle, over a period of days or weeks, and this feature facilitates removal of lees and sediments from the bottle.

DETAILED DESCRIPTION

Figure 2:
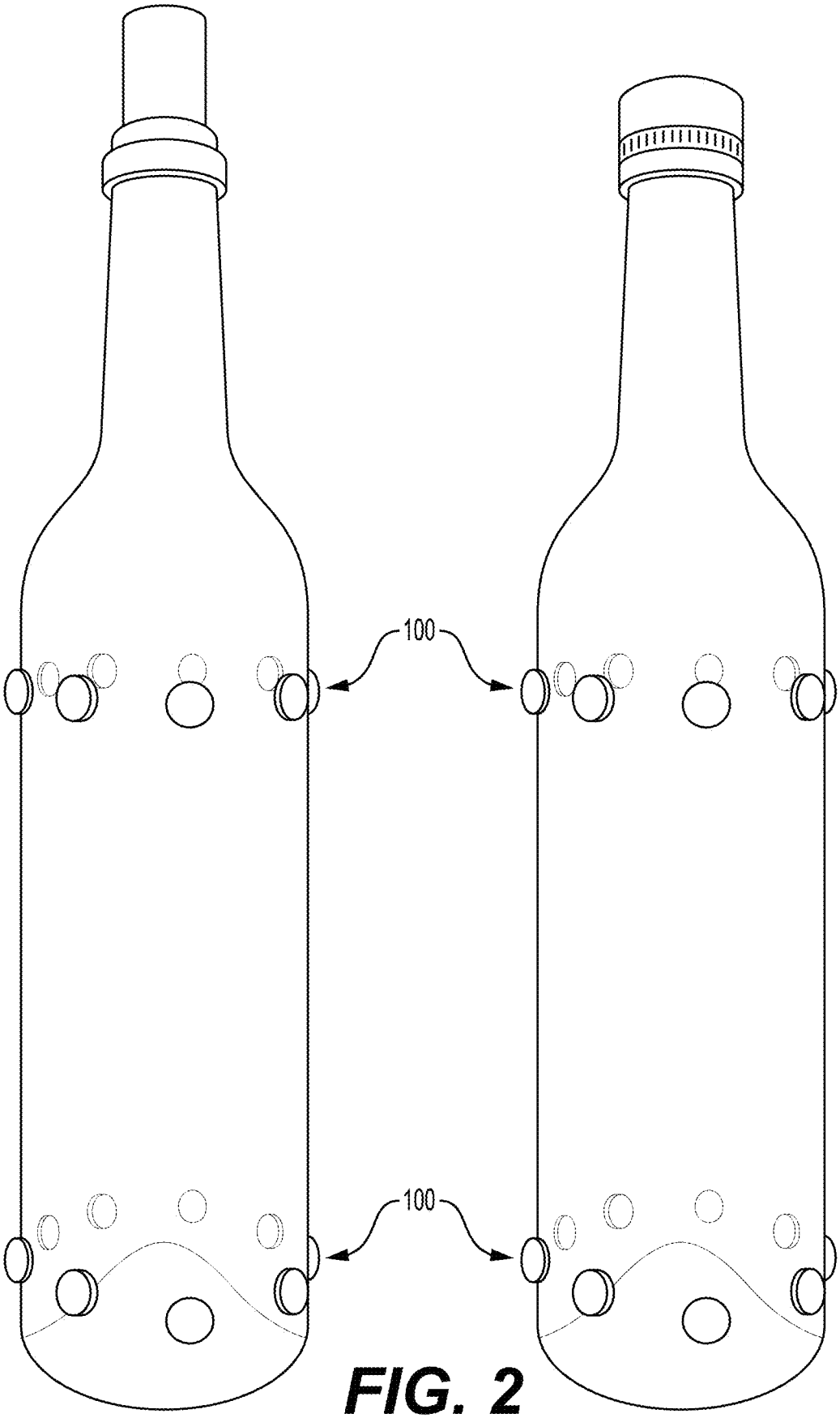
FIG. 2 is a photograph of two 750 ml Bordeaux style glass wine bottles having cork and screw cap closures respectively, and whose upper and lower body portions have each been decorated with nine clear vinyl adhesive bumpers 100 positioned approximately 1 inch above the base and 1 inch below the shoulder of the bottles, and spaced at 1.05 inch intervals around the approximate 9.5 inch circumference of the bottles to provide a size and visual approximation of 750 ml wine bottles having rotationally stabilizing integral glass or thermoplastic resin bumpers.
Figure 3:
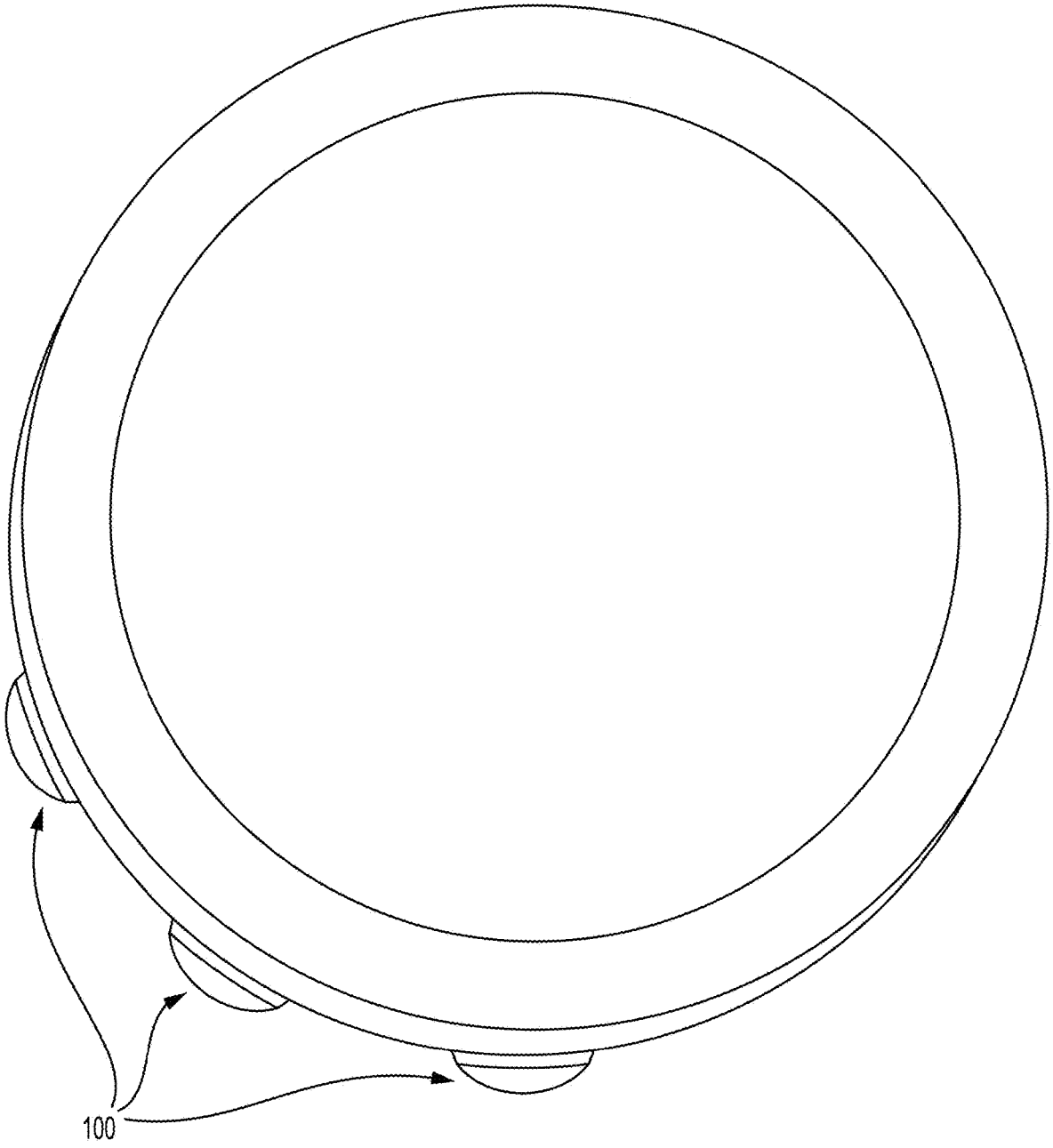
FIG. 3 is a photograph of one of the 750 ml Bordeaux style glass wine bottles of FIG. 2 in which the bottle has been placed on its side with a pair of clear vinyl adhesive bumpers 100 contacting a flat shelf surface to illustrate the stabilization against rolling that would be provided by similar sized glass or thermoplastic resin bumpers.

The inventor produced prototype wine bottles in which the outer sidewall circumference of the body of conventional glass wine bottles has been fitted with commercially available small round adhesive bumpers similar in size to the glass or thermoplastic resin protrusions described in the present disclosure. Attachments of these bumpers with center to center spacings of approximately one inch around a 750 ml bottle's circumference are shown in FIGS. 2 and 3. These spacings were tested and shown to prevent 750 ml and 1.5 L wine bottles from rolling on a flat surface when that surface is tilted at an angle of greater than 10 degrees and up to at least 15 degrees. It is anticipated that when glass bottles, such as wine bottles, are molded in soda lime silica glass with small glass or thermoplastic resin protrusions (referred to herein as "bumpers"), the approximate shape of the bumpers can be similar to that shown in FIG. 2. For example, each bumper may be approximately 1 cm (e.g., 0.5-1.5 cm) in diameter and can project from the outer sidewall surface of the bottle between 2 mm and 6 mm (preferably between about 2 mm to about 4 mm and more preferably between about 2.5 mm to about 3 mm for a 750 ml bottle, and preferably between about 3 mm to about 6 mm and more preferably between about 4 mm and about 5 mm for a 1.5 L bottle).

Figure 4:
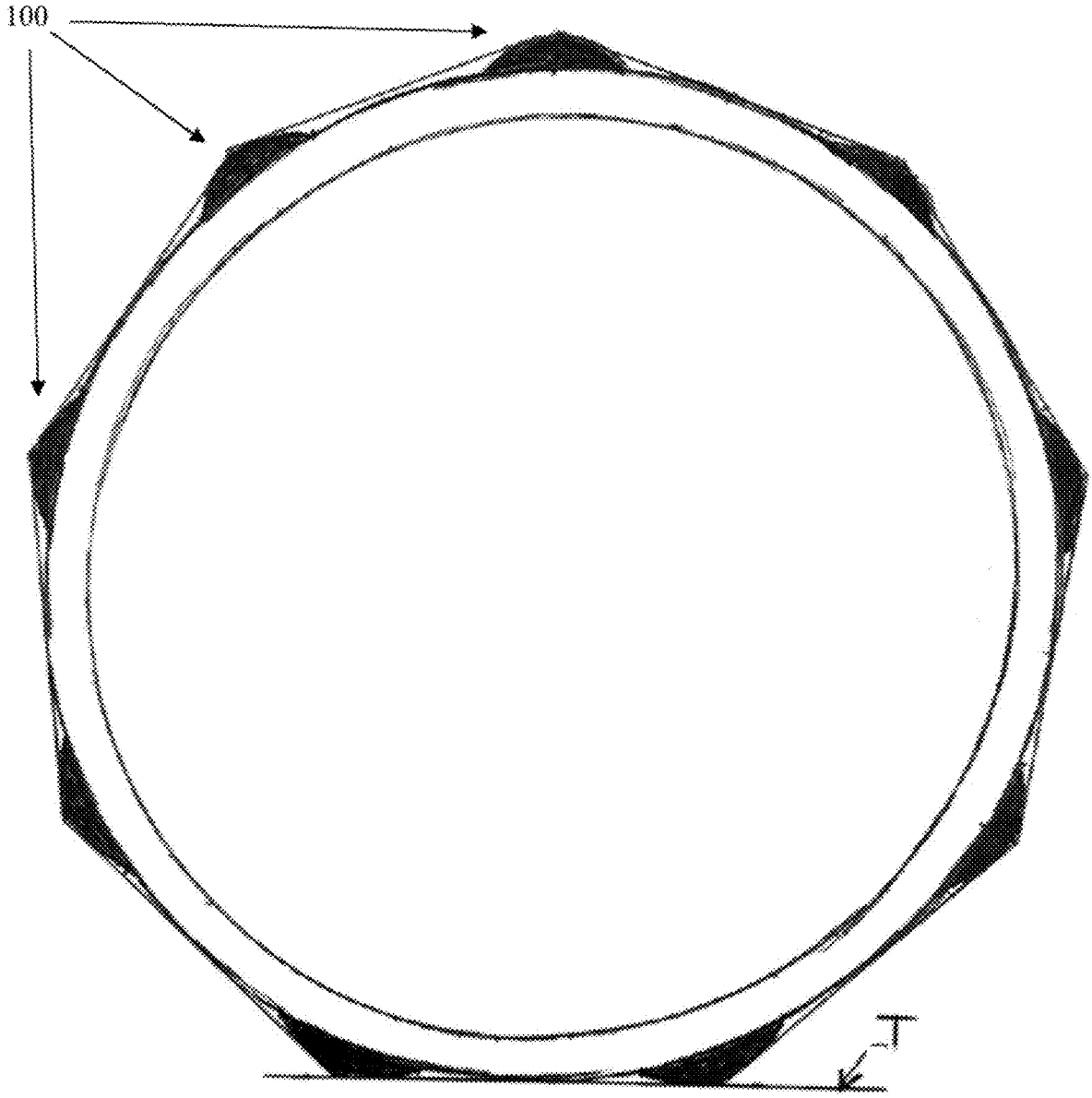
FIG. 4 is a cross-sectional drawing of a 750 ml wine bottle viewed across the cylindrical body portion of the bottle, where nine protruding anti-roll bumpers 100 (in black) are spaced at 1.05 inch intervals around the approximate 9.5 inch circumference of the exterior wall surface of the bottle, where "T" denotes a line drawn tangent between two adjacent bumpers.
Figure 5:
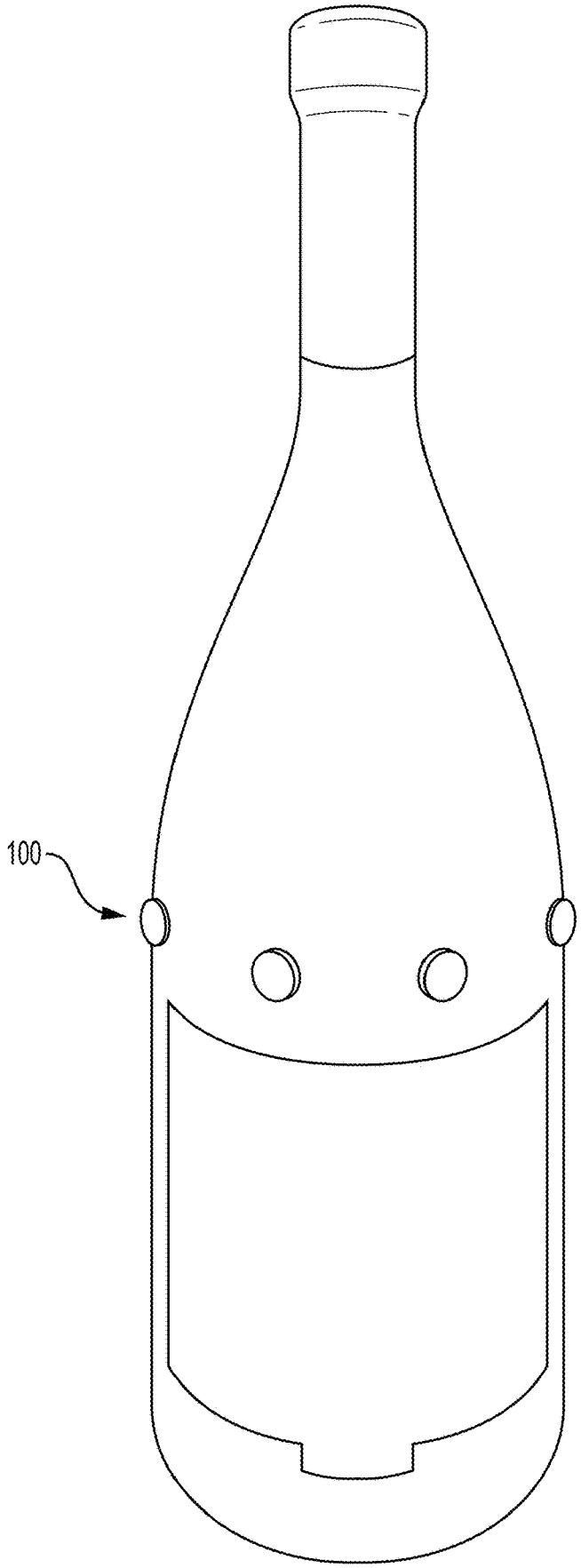
FIG. 5 is a photograph of a 1.5 L wine bottle having a cork closure, and whose upper body portion has been decorated with nine clear vinyl adhesive bumpers 100 positioned approximately 1 inch below the shoulder of the bottle, and spaced at 1.44 inch intervals around the approximate 13 inch circumference of the bottle to provide a size and visual approximation of a 1.5 L wine bottle having rotationally stabilizing integral glass or thermoplastic resin bumpers.
Figure 6:
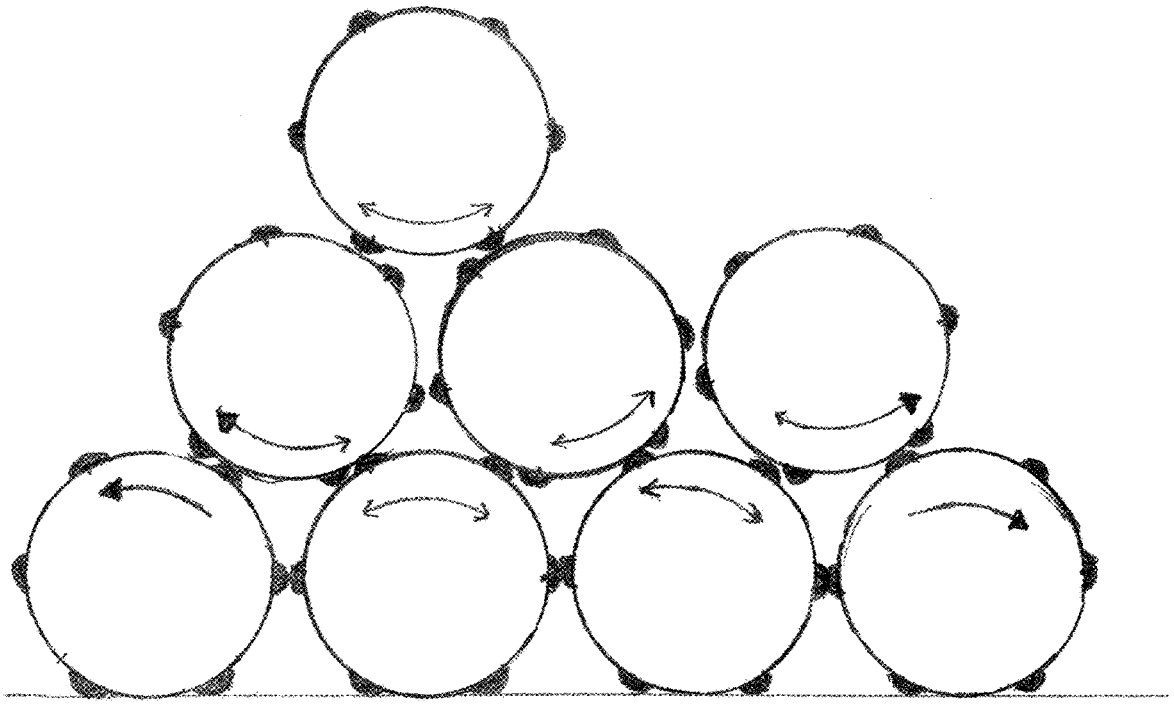
FIG. 6 is a cross-sectional drawing of multiple wine bottles with bumpers stacked in multiple layers on a flat surface, as viewed across the cylindrical body portion of the bottle. Arrows show the likely direction of pressure in the multiple layers.

The spacing of the bumpers around differently sized and/or shaped glass bottles can vary depending on the diameter of the bottle as shown in FIG. 4 such that the tangent line (T) should preferably lie slightly outside the surface of the bottle between neighboring bumpers.

The bumpers can comprise glass or a thermoplastic resin. The bumpers can be integrally molded into the outer sidewall surface of the substantially cylindrical body portion of a glass bottle.

In an embodiment, a typical 750 ml capacity Bordeaux or Burgundy style wine bottle having an approximate 3.0-3.25 inch outer diameter (and thus about 9-10 inch circumference), the centers of approximately 8-10 such bumpers should be spaced at equal intervals (approximately 0.9-1.5 inches apart, preferably about 1.0 to 1.3 inches apart) around the circumference of the body portion of the bottle near the shoulder and/or base of the wine bottle.

In another embodiment, a 1.5 L bottle having an outer diameter of approximately 4.15 inches (and approximately 13-inch circumference), the centers of approximately 8-10 such bumpers should be spaced at approximately equal intervals (approximately 1.2 to 1.8 inches apart, preferably about 1.3 to 1.6 inches apart) around the circumference of the body portion of the bottle near the shoulder and/or base of the wine bottle.

In an embodiment, at least two approximately parallel and essentially identical circumferential paths are selected for positioning the bumpers around the bottle's outer sidewall circumference, with one circumferential path located near the base of the bottle and the other circumferential path located near the shoulder of the bottle. Preferably, one circumferential path is located approximately 1 to 2 inches from the base of the bottle, and a second circumferential path is located approximately 1 to 2 inches from the shoulder of the bottle. In other words, the circumferential paths are separated by about 3-7 inches, preferably about 4-6 inches, measured along the central axis of the 750 ml bottle or the 1.5 L bottle. The location of the circumferential paths in these portions of the bottle enables attachment of a label to the center of the bottle without interference from the bumpers. Pairs of the bumpers along these two paths can be aligned with each other parallel to the central axis of the bottle to prevent rocking of the bottle when resting on its side on a flat surface. This separation can provide stabilization against rolling along the length of the bottle.

In an embodiment, the outermost surface of the bumpers upon which the bottle rests can be typically contoured for improved bottle stability against rolling, i.e., bevel-contoured, V-shaped, or otherwise contoured (see body cross-section in FIG. 4).

In an embodiment, the bumpers project sufficiently above the surface of the bottle (e.g., 2 mm-4 mm and preferably about 2.5 mm to about 3 mm for a 750 ml bottle, or 3 mm-6 mm and preferably 4 mm-5 mm for a 1.5 L bottle) so that a tangent line (see "T" in FIG. 4 cross-section) connecting the outermost surface of each successive pair of bumpers lies just outside the curving surface of the bottle between each pair of the bumpers. With this geometry, each pair of bumpers can serve as supportive "feet" upon which a bottle that has been placed on its side can rest without rocking or rolling.

Because a series of bumpers preferably lie in evenly spaced pattern around the circumference of the bottle, the bottle can be stable regardless of the rotational position of the bottle. As described above, it is preferred that at least two matching, i.e., essentially identical, circumferential paths of bumpers are formed around the circumference of the bottle separated by several inches (e.g., 3-7 inches, preferably about 4-6 inches measured along the central axis of the 750 ml bottle or the 1.5 L bottle). If one circumferential path of bumpers is positioned high and one low on the outside wall of the bottle's essentially cylindrical body portion, the bottle is well stabilized against rolling along its full length. In addition to preventing wine bottles from rolling along a storage shelf, the bumpers also help stabilize a stack of bottles against movement after the bottles have been placed horizontally atop one another on a surface. Integral glass or thermoplastic resin bumpers as described herein add negligible weight or cost to a bottle and do not alter the bottle's interior shape nor a bottle's pouring qualities. For example, with typical soda lime glass bottles having a wall thickness of approximately 2.8-3.3 mm, the glass or thermoplastic resin bumpers described herein project about 2 mm to 4 mm, preferably about 2.5 mm to 3 mm from the outer sidewall surface of the bottle for a 750 ml bottle and about 3 mm to 6 mm, preferably about 4 mm to 5 mm, for a 1.5 L bottle. Therefore, each small bumper produces only a very small and localized increase in the bottle's glass wall thickness over a remarkably small area. Glass bottles described herein may be easily manufactured using existing glass bottle molds in which small bumper-shaped depressions can be machined or otherwise formed in the mold's surface forming the exterior wall surface of the glass bottle. See FIGS. 2-4.

A mathematical formula may be used for calculating the amount of added glass required to form, for example, 18 glass bumpers being used to stabilize a 750 ml capacity bottle against rolling. The volume of each protruding bumper can be approximated and calculated by the volume of the cap portion of a sphere. In this instance, the volume of each bumper having a height of 0.25 cm and a base radius of about 0.5 cm, is approximately 0.14 $cm^3$ so that 18 such bumpers will have a volume of 2.5 $cm^3$. With soda lime glass having a density of 2.5 g per $cm^3$ the weight of 18 such bumpers will be approximately 6 g. An average 750 ml capacity empty glass wine bottle weighs between 500 and 600 g and the same bottle filled with wine weighs approximately 1300 g. Therefore, a wine bottle's weight will increase by only about 1% when empty or approximately 0.5% when filled with wine by the addition of the stabilizing bumpers. These additions likely will not measurably alter the manufacturing process for a glass bottle nor the cost of shipping empty or filled wine bottles.

With regard to bottle manufacture, the fabrication of a glass bottle containing approximately 1% by weight added glass that is essentially symmetrically distributed among 16-20 small glass bumpers around the circumference of the bottle's body can be accomplished. Addition of small amounts of glass or thermoplastic resin around the bottle can be achieved by removing very small portions of the ferrous alloy-based tool that is usually employed to mold the outer surface of the body portion of the wine bottle. It is believed the minor alteration required in the bottle-forming tool will not appreciably alter the manufacturing process such as the molding temperature or the mold cycling time. Nor should the addition of small bumpers to the exterior surface of the wine bottle alter the process of filling or sealing the bottle with either a cork or a screwcap style of closure. Importantly, the present invention prevents free rolling/rotation of the bottle while also allowing discrete step-wise rotation between successive pairs of the bumpers on the exterior of the bottle. For example, with a bottle having either 8 or 9 bumpers, each successive rotation step will provide 360 degrees÷8 (or ÷9)=45 degrees (or 40 degrees) of rotation. The present invention can be achieved without any alteration of the substantially cylindrical interior body portion of the bottle. Therefore, the volume and mechanics of liquid filling and pouring from the bottle can remain unchanged. Furthermore, it is expected that there is minimal change in the weight of the bottle, its outer diameter, its method of manufacture, its mechanical handling, its cost, or its packaging requirements for shipping.

In modeling wine bottles of the present invention, it is surprising that nine bumpers positioned at equal intervals (about 0.9 to 1.5 inches apart, preferably 1.0 to 1.2 inches apart) around the circumference of a 3 inch diameter wine bottle (750 ml) at approximately 1 to 2 inches from the base and/or shoulder of the bottle can provide excellent mechanical stability against bottle rolling while protruding outward only 2.5 mm to 3 mm from the outer sidewall surface of the wine bottle (approximately 3% of the bottle's diameter). Similarly, nine bumpers positioned at equal intervals (approximately 1.2 to 1.8 inches apart, preferably 1.3 to 1.6 inches apart) around the circumference of a 4.15 inch diameter 1.5 L bottle at approximately 1 to 2 inches from the base and/or shoulder of the bottle also provide excellent mechanical stability against bottle rolling while protruding outward approximately 4 to 5 mm from the surface of the wine bottle (approximately 4% of the bottle's diameter). The term "excellent stability" against bottle rolling refers to the ability of a glass wine bottle having an outer diameter of approximately 3 inches, a capacity of 750 ml and a weight of between 500 and 600 g to resist rolling when placed on a flat surface inclined at an angle of 15 degrees elevation. From another perspective, these 2.5 mm tall bumpers can provide a series of nine "stabilizing platforms" around the circumference of the 750 ml bottle that are each approximately one inch (25 mm) wide or about ten-fold wider than the 2.5 mm projecting height of each bumper. From another perspective, pairs of these 4-5 mm tall bumpers can provide a series of nine "stabilizing platforms" around the circumference of the 1.5 L bottle, in which the platforms are each approximately 1.44 inches (37 mm) wide or about ten-fold wider than the 4-5 mm projecting height of each bumper.

For a variety of reasons including packaging considerations, it is very helpful to avoid significantly increasing the outer diameter of the glass wine bottle. Accordingly, with the presently described example of a 3.0 inch diameter (76 mm) wine bottle having essentially diametrically opposed glass or thermoplastic resin bumpers on the exterior wall of the bottle (each bumper being only 2.5 mm tall), the bottle's maximum diameter measured across opposed bumpers is only 5 mm greater than the original 76 mm diameter. This represents only about a 6.5% very localized increase in the bottle's maximum outer diameter. It is interesting to note that the anti-rolling feature of this invention is built into the wine bottle's architecture whereas most of the prior art devices that prevent bottle rolling are accessory devices that are less convenient and require separate purchasing. Additionally, this invention leaves the essential shape of the original wine bottle intact with addition of only about 1% to the amount of glass used to form the bottle. This invention solves the wine bottle rolling problem and also facilitates stacking of bottles.

Although preferred embodiments of this invention include glass wine bottles, the invention is not so limited. Any glass (or thermoplastic) cylindrical bottle or jar can be modified with bumpers according to the present invention, and their spacing around the outer surface of the bottle can be determined in a similar manner as described herein for the 750 ml and 1.5 L wine bottles. For example, preferably 8 or 9 bumpers can be added in a single circumferential path near the bottom and/or top of a cylindrical glass bottle, or alternatively 16 to 18 bumpers can be added in two circumferential paths near the bottom and top of a cylindrical glass bottle, such that the bumpers are evenly spaced along the outer surface. The composition, shape and dimensions of such bumpers are as described herein.

Non-limiting examples of such glass cylindrical bottles or jars include water bottles, liquor bottles, beer bottles, pickle jars, jam or jelly jars, solvent bottles, and vinegar bottles.

DEFINITIONS

Figure 1A:
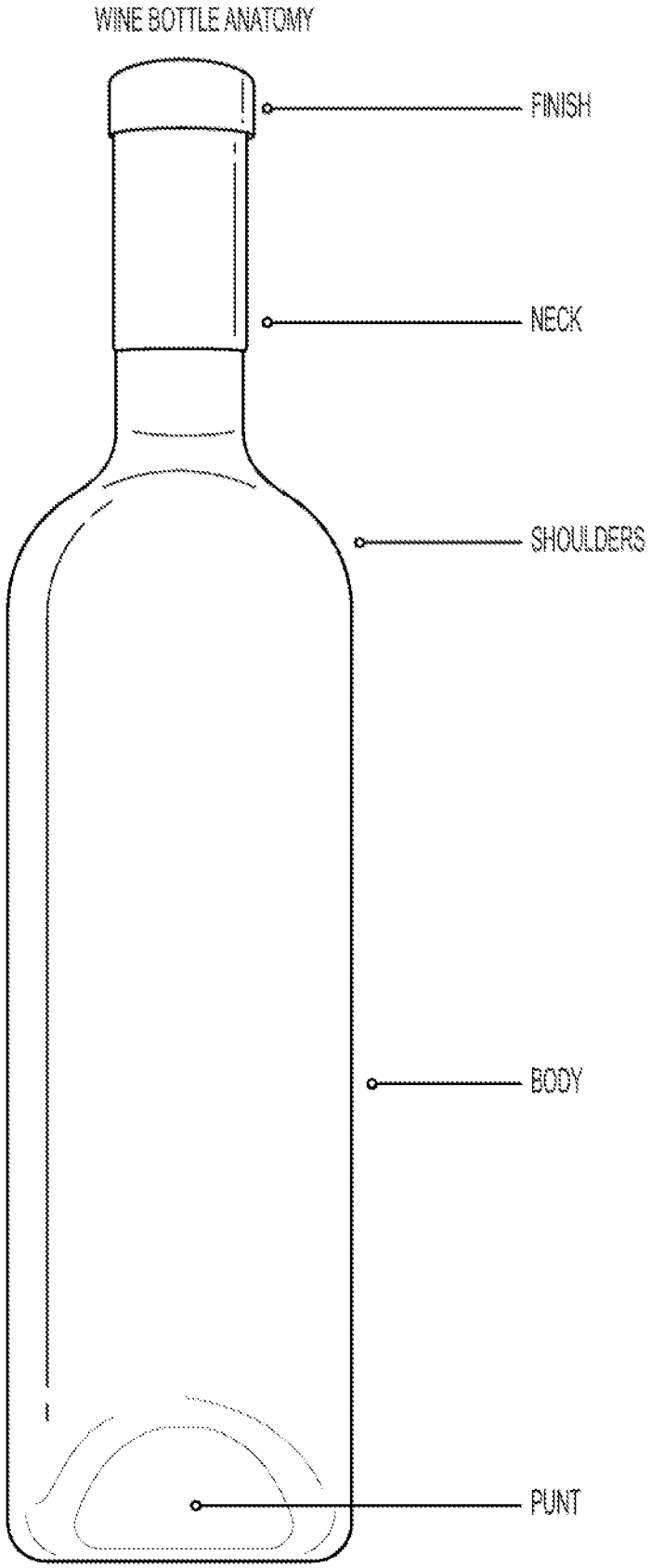
FIG. 1A illustrates a side view of a typical Bordeaux style wine bottle, with its structural portions named and labeled. The bottle's heel or base upon which the upright bottle rests is not labeled. The labeled "punt" is a recessed empty space formed in the bottom of the bottle.
Figure 1B:
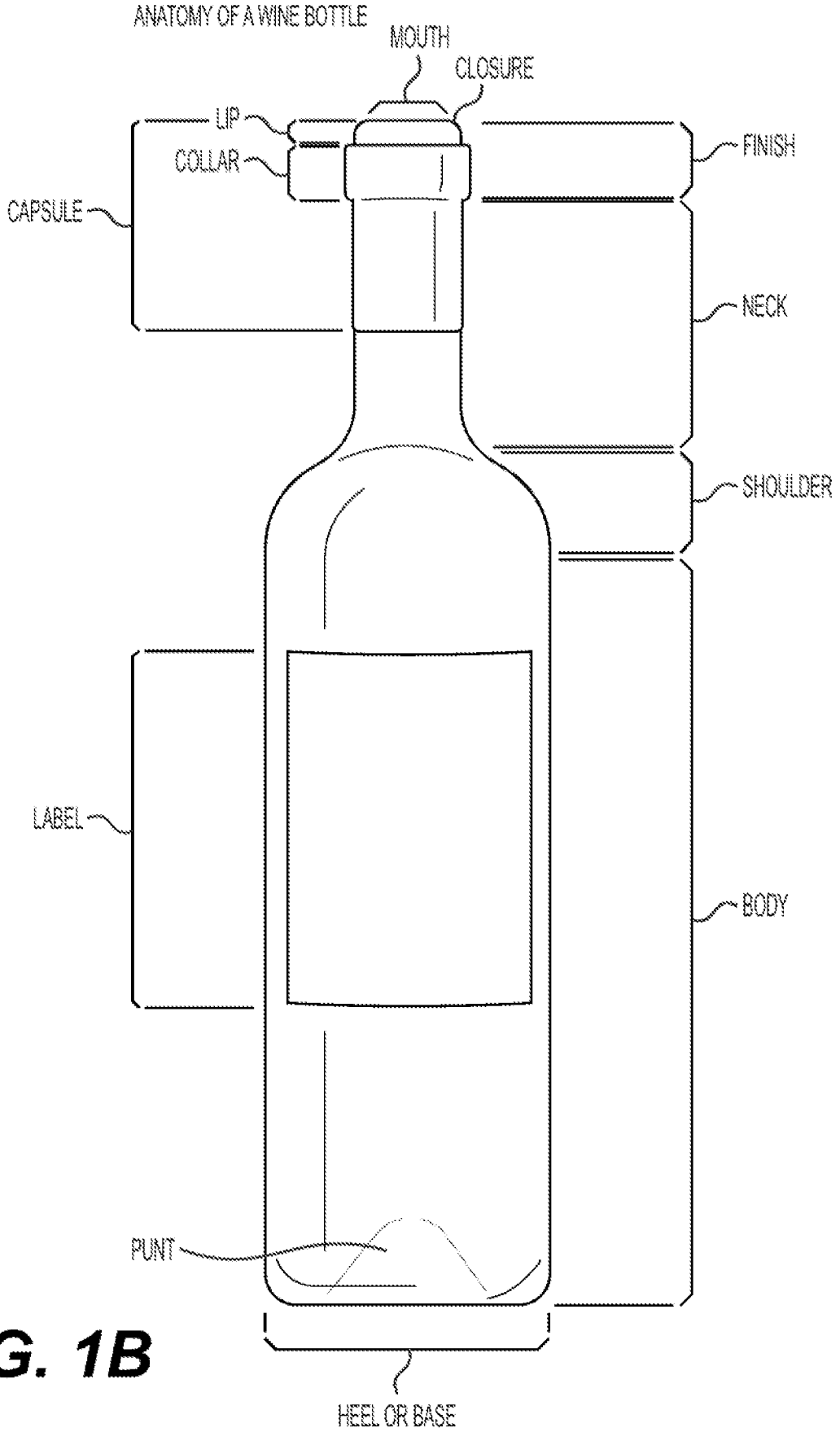
FIG. 1B is a side view of a Bordeaux style bottle similar to FIG. 1A except that it illustrates the uppermost portion of the neck of the bottle in greater detail and also shows typical location for attaching a wine label to the body portion of a bottle.

Within the present disclosure and within the claims that establish the novelty of the present invention, the following terms have the following meanings:

The term "cylindrical" as used herein, refers to the shape of the sidewall of the body portion of most glass bottles such as Bordeaux and Burgundy style wine bottles (including 750-1000 ml bottles and 1.5 L bottles. The body portion of these bottles (see FIG. 1A and B) has an approximately circular cross-section and approximately straight sides. Although the sidewalls of the body portion are often slightly tapered, with the bottle often broader near the shoulder and narrower near the base of the bottle, the body is still considered substantially cylindrical.

The term "modified" as used herein, refers to bottles with a substantially cylindrical body portion (such as traditional Bordeaux and Burgundy style wine bottles) in which the outer sidewall surface of the body portion has been altered. More specifically, the modification refers to surface protrusions (collectively termed "bumpers") that are typically 2-5 mm tall and that are carefully positioned and molded into the outer sidewall surface during bottle fabrication from glass, e.g., from soda lime bottle glass, or from a thermoplastic resin. Without these surface modifications, a substantially cylindrical bottle that is stored on its side may roll and accidentally fall and fracture on a hard floor.

The term "circumferential path" as used herein, refers to the positioning of protruding bumpers around the exterior sidewall of a bottle's body portion. This positioning may follow either one circumferential path or two approximately parallel circumferential paths around the bottle's body (an upper path nearer the bottle's shoulder, and/or a lower path nearer the base of the bottle). The path should be located approximately 1 to 2 inches from either the shoulder of the bottle or the base of the bottle. If the bumpers are positioned along two paths, the paths should be separated by several inches, e.g., 3-7 inches (measured along the central axis of a 750 ml bottle or a 1.5 L bottle) for maximum stabilization of the bottle against rolling. The circumferential paths should be approximately 1 to 2 inches from the shoulder of the bottle, and approximately 1-2 inches from the base of the bottle. The paths can be separated by about 3-7 inches, preferably about 4-6 inches, measured along the central axis of the 750 ml bottle or the 1.5 L bottle.

The term "glass" as used herein, refers to a heat-meltable and moldable material useful in the manufacture of glass bottles, and includes thermoplastic resins as well as any traditional silica-based glass such as common soda lime glass used to manufacture most bottles. If a thermoplastic resin is used in place of silica-based glass, the resin may include but is not limited to PET (polyethylene terephthalate), polyethylene, polypropylene and the biopolymer, PLA (polylactide).

The number of bumpers formed on the surface of a bottle may vary considerably. For example, 8-12 bumpers, preferably 8 or 9 bumpers, may be formed around a bottle if the bumpers are limited to one circumferential path around a 750 ml bottle or a 1.5 L bottle. Approximately twice that number, i.e., about 16-24 bumpers, or preferably 16 to 18 bumpers, may be formed around a 750 ml bottle or a 1.5 L bottle if the bumpers are distributed around two separated circumferential paths. When two paths are utilized, pairs of bumpers in the upper and lower paths around the outer sidewall surface of the bottle should align with each other parallel to the central axis of the bottle so the bottle does not rock when placed on a shelf or other flat surface. As discussed elsewhere in the present disclosure, bumpers can typically project between 1 mm and 5 mm, and preferably between 2 mm and 4 mm outward from the outer sidewall surface of a 750 ml wine bottle or between 3 to 6 mm, preferably between 4 to 5 mm outward from the outer sidewall surface of a 1.5 L bottle. Furthermore, the outermost surface of the bumpers upon which the horizontally stored bottle rests, can be formed with a beveled, V-shaped or otherwise contoured surface to maximize contact between the bumpers and the support surface for the bottle such as a shelf.

What is claimed is:

1. A glass wine bottle consisting a body portion that includes a base, a substantially cylindrical side portion, and a shoulder, wherein the substantially cylindrical side portion comprises an inner sidewall surface and an outer sidewall surface, wherein the glass wine bottle is modified to remedy its susceptibility to rolling and accidental breakage when the glass wine bottle is stored on its side rather than upright on its base, wherein the outer sidewall surface is structurally modified to prevent rolling by addition of a plurality of between 8 and 24 bumpers positioned and formed at regular intervals along only two circumferential paths around the outer sidewall surface, wherein a center to center distance between consecutive bumpers is at least 1.0 inch, wherein the plurality of bumpers project between 2 mm and 6 mm outward from the outer sidewall surface, thereby enabling at least one pair of consecutive bumpers to support the bottle stored on its side without the glass wine bottle rocking or rolling, and wherein the at least one pair of consecutive bumpers have a tangent line between a highest point on each of the consecutive bumpers that does not intersect the surface of the bottle between the at least one pair of consecutive bumpers.

2. The glass wine bottle of claim 1, wherein the glass wine bottle holds a liquid volume of between approximately 750 ml and 1500 ml, wherein the plurality of bumpers are spaced at regular intervals of between approximately 1.0 and 1.5 inches, preferably 1.0 to 1.3 inches, measured center to center, along either:

a first circumferential path of the two circumferential paths located between approximately one inch and two inches from the shoulder or the base of the glass wine bottle, or a first circumferential path of the two circumferential paths and a second circumferential path of the one or two circumferential paths, the first circumferential path and the second circumferential path separated from one another, the first circumferential path located between approximately one inch and two inches from the shoulder and the second circumferential path located between approximately one inch and two inches from the base of the glass wine bottle, and wherein the plurality of bumpers protrude between 2 mm and 4 mm, preferably between about 2.5 mm to about 3 mm, outward from the outer sidewall surface.

3. The glass wine bottle of claim 1, wherein the glass wine bottle is sealed by either a stopper or cork style closure or a screwcap style closure.

4. The glass wine bottle of claim 1, wherein the style of glass wine bottle is selected from the group including Burgundy and Bordeaux style wine bottles.

5. The glass wine bottle of claim 1, wherein the glass wine bottle holds a liquid volume of between approximately 750 ml and 1000 ml.

6. The glass wine bottle of claim 1, wherein the plurality of bumpers include between 8 and 12 bumpers positioned approximately equal distances apart on a first circumferential path of the two circumferential paths around the glass wine bottle's body portion located between approximately 1 inch and 2 inches from the shoulder or the base of the glass wine bottle.

7. The glass wine bottle of claim 1, wherein the plurality of bumpers include between 8 and 10 bumpers positioned approximately equal distances apart on a first circumferential path of the two circumferential paths around the glass wine bottle's body portion located between approximately 1 inch and 2 inches from the shoulder or the base of the glass wine bottle.

8. The glass wine bottle of claim 1, wherein the plurality of bumpers include between 16 and 24 bumpers positioned approximately equal distances apart on two separated circumferential paths of the two circumferential paths around the glass wine bottle's body portion, the first separated circumferential path located between approximately 1 inch and 2 inches from the shoulder of the glass wine bottle and the second separated circumferential path located between approximately 1 inch and 2 inches from the base of the glass wine bottle.

9. The glass wine bottle of claim 8, wherein the first and second separated circumferential paths are separated by a distance of between 3 inches and 7 inches measured along the central axis of the glass wine bottle.

10. The glass wine bottle of claim 8, wherein the first and second separated circumferential paths are separated by a distance of between 4 inches and 6 inches measured along the central axis of the glass wine bottle.

11. The glass wine bottle of claim 5, wherein the plurality of bumpers project between about 2 mm and about 4 mm, preferably between about 2.5 mm and about 3 mm, outward from the outer sidewall surface.

12. The glass wine bottle of claim 1, wherein the plurality of bumpers are formed in the shape of substantially round button-like structures, and whose outermost surfaces upon which the glass wine bottle rests, are beveled or otherwise contoured for improved bottle stability against rolling.

13. The glass wine bottle of claim 1, wherein the plurality of bumpers are formed in the shape of elongated strips, and whose outermost surfaces upon which the glass wine bottle rests, are beveled or otherwise contoured for improved bottle stability against rolling.

14. The glass wine bottle of claim 1, wherein the plurality of bumpers that support the glass wine bottle and prevent glass wine bottles stored side by side from readily rotating and rolling, also enable and facilitate the stacking of multiple layers of glass wine bottles.

15. The glass wine bottle of claim 1, wherein the plurality of bumpers that are spaced apart at regular intervals around the circumference of the glass wine bottle, allow controlled step-wise rotation of the glass wine bottle in angular increments over a period of days thereby enabling and facilitating removal of lees and sediments from the glass wine bottle.

16. The glass wine bottle of claim 1, wherein the glass wine bottle holds a liquid volume of approximately 1.5 L.

17. The glass wine bottle of claim 16, wherein the plurality of bumpers are spaced at regular intervals of between approximately 1.2 and 1.8 inches, preferably 1.3 and 1.6 inches, measured center to center, along either:

a first circumferential path of the two circumferential paths located between approximately one inch and two inches from the shoulder or the base of the glass wine bottle, or a first circumferential path of the two circumferential paths and a second circumferential path of the two circumferential paths, the first circumferential path and the second circumferential path separated from one another, the first circumferential path located between approximately one inch and two inches from the shoulder and the second circumferential path located between approximately one inch and two inches from the base of the glass wine bottle, and wherein the plurality of bumpers protrude between 3 mm and 6 mm, preferably between about 4 mm and about 5 mm, outward from the outer sidewall surface.

18. The glass wine bottle of claim 16, wherein the plurality of bumpers protrude between 3 mm and 6 mm, preferably between about 4 mm and about 5 mm, outward from the outer sidewall surface.

19. The glass wine bottle of claim 1, wherein the plurality of bumpers comprise glass or a thermoplastic resin.

* * * * *